US009732471B2

(12) United States Patent
Caspar

(10) Patent No.: US 9,732,471 B2
(45) Date of Patent: Aug. 15, 2017

(54) DRAIN APPARATUS FOR A DRY STRAINER CLEANING HEAD

(71) Applicant: Roman Caspar, Beaconsfield (CA)

(72) Inventor: Roman Caspar, Beaconsfield (CA)

(73) Assignee: PAPRIMA INDUSTRIES INC., Dorval (Montreal) (CA)

( * ) Notice: Subject to any disclaimer, the term of this patent is extended or adjusted under 35 U.S.C. 154(b) by 0 days.

(21) Appl. No.: 14/727,322

(22) Filed: Jun. 1, 2015

(65) Prior Publication Data

US 2016/0348312 A1 Dec. 1, 2016
US 2017/0191219 A9 Jul. 6, 2017

Related U.S. Application Data

(62) Division of application No. 13/180,689, filed on Jul. 12, 2011, now Pat. No. 9,044,782.

(30) Foreign Application Priority Data

Jul. 12, 2010 (DE) ..... 10 2010 026 831

(51) Int. Cl.

| | |
|---|---|
| ***D21F 1/32*** | (2006.01) |
| ***D21F 7/00*** | (2006.01) |
| ***A47L 11/40*** | (2006.01) |
| ***A47L 7/00*** | (2006.01) |
| ***A47L 9/16*** | (2006.01) |
| ***A47L 11/30*** | (2006.01) |
| ***B07B 1/55*** | (2006.01) |
| ***B08B 3/02*** | (2006.01) |
| ***B08B 15/04*** | (2006.01) |

(52) U.S. Cl.

CPC ..... *D21F 7/00* (2013.01); *A47L 7/0004* (2013.01); *A47L 7/0009* (2013.01); *A47L 9/1608* (2013.01); *A47L 11/30* (2013.01); *A47L 11/4016* (2013.01); *A47L 11/4044* (2013.01); *A47L 11/4097* (2013.01); *B07B 1/55* (2013.01); *B08B 3/024* (2013.01); *B08B 15/04* (2013.01); *D21F 1/325* (2013.01); *B08B 2203/0229* (2013.01)

(58) Field of Classification Search

CPC ..... A47L 7/00; B07B 1/55; B08B 3/02
USPC ..... 162/199, 272
See application file for complete search history.

(56) References Cited

U.S. PATENT DOCUMENTS

| | | | |
|---|---|---|---|
| 1,550,304 | A | 8/1925 | Dolan et al. |
| 1,737,680 | A | 12/1929 | Pinkham |
| 3,362,752 | A | 1/1968 | Densmore |
| 3,737,940 | A | 6/1973 | Moestue et al. |
| 3,775,095 | A | 11/1973 | Gulyas et al. |
| 3,974,541 | A | 8/1976 | Silvis et al. |
| 4,377,021 | A | 3/1983 | Peters |
| 6,143,092 | A | 11/2000 | Straub et al. |
| 7,293,324 | B2 | 11/2007 | Chui et al. |
| 2003/0076673 | A1 | 4/2003 | Diak et al. |
| 2005/0060832 | A1 | 3/2005 | Chui et al. |
| 2009/0300870 | A1 | 12/2009 | Riach et al. |

FOREIGN PATENT DOCUMENTS

| | | | |
|---|---|---|---|
| CN | 1596814 | A | 3/2005 |
| DE | 29517859 | | 2/1996 |
| DE | 69314805 | | 2/1998 |
| DE | 102007028341 | | 12/2008 |
| EP | 1085121 | | 3/2001 |
| EP | 1361045 | A1 | 11/2003 |
| EP | 1649942 | A1 | 4/2006 |
| FR | 2826597 | A1 | 6/2001 |
| JP | 1246488 | A | 10/1989 |
| WO | WO 98/53136 | A1 | 11/1998 |
| WO | WO 2005113890 | | 12/2005 |
| WO | WO 2008151814 | | 12/2008 |
| WO | WO 2011/077263 | A3 | 9/2011 |

OTHER PUBLICATIONS

Examination Report in DE 102010026831, dated Mar. 18, 2011.
Examination Report in DE 102009059790, dated Aug. 6, 2010.
International Search Report for PCT/EP2005/051927, dated Aug. 16, 2005.
European Patent Office, Examination Report in European Patent Application No. 11 005 676.9 (dated Jul. 12, 2013).
State Intellectual Property Office of the People's Republic of China, Office Action and Search Report in Chinese Patent Application No. 201110203470.4 (dated Jun. 5, 2014).

*Primary Examiner* — Mark Halpern
(74) *Attorney, Agent, or Firm* — Leydig, Voit & Mayer, Ltd.

(57) ABSTRACT

A drainage device for removing dirt particles and wastewater from a cleaning head for cleaning a dryer screen of a paper production plant includes an air-water separation container. The air-water separation container includes an air outlet, a wastewater outlet and an inlet opening for receiving the dirt particles and the wastewater from the cleaning head. The air-water separation container is connected to the cleaning head so as to be movable transversely relative to the dryer screen together with the cleaning head.

8 Claims, 7 Drawing Sheets

DRAIN APPARATUS FOR A DRY STRAINER CLEANING HEAD

CROSS REFERENCE TO PRIOR APPLICATIONS

This application is a divisional of U.S. patent application Ser. No. 13/180,689, filed Jul. 12, 2011, now U.S. Pat. No. 9,044,782, which claims priority to German Patent Application No. DE 10 2010 026 831.3, filed Jul. 12, 2010.

FIELD

The invention relates to a drainage system for a cleaning head tor cleaning a dryer screen in a paper production plant.

BACKGROUND

There are various embodiments of cleaning heads in the prior art. However, attention was previously seldom paid to the design of frictionless drainage devices for such cleaning heads. WO 2008/151814 describes a drainage device in which the dirt particles and the waste water are carried from the cleaning head into a collection container ("disposal device") installed rigidly transversely above the material web to be cleaned. The collection container has a slit which extends transversely over the entire width of the material web and through which the cleaning head movable transversely to the material web protrudes via its end into the collection container.

A drawback of the prior art is that the dirt particles and the waste water are deposited on the walls on their way through the drainage device. As soon as too many residues are deposited on the wall surfaces in the drainage device, these must be manually cleaned so that the drainage device does not become blocked.

SUMMARY OF THE INVENTION

In an embodiment, the present invention provides a drainage device for removing dirt particles and wastewater from a cleaning head for cleaning a dryer screen of a paper production plant. An air-water separation container includes an air outlet, a wastewater outlet and an inlet opening for receiving the dirt particles and the wastewater from the cleaning head. The air-water separation container is connected to the cleaning head so as to be movable transversely relative to the dryer screen together with the cleaning head.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 8 is a diagonal front view of a perspective illustration of a drainage device according to an embodiment of the invention, wherein the transition of the tubular body into the air-water separation container is visible.

DETAILED DESCRIPTION

Figure 1:
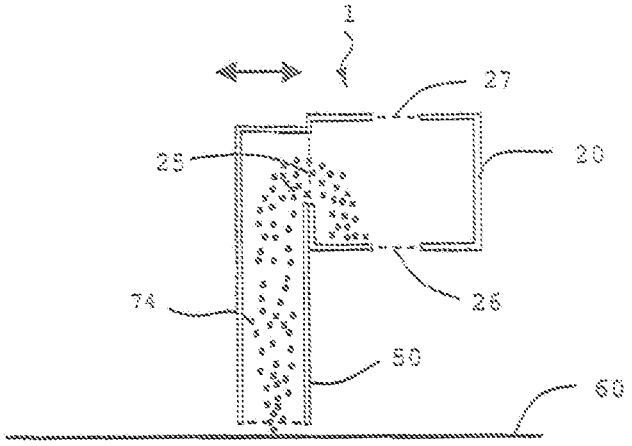
FIG. 1 shows a drainage device according to an embodiment of the invention which is connected to a cleaning head.

In an embodiment of the invention, the drainage system includes cleaning heads that clean the dryer screen soiled by pulp residues using high-pressure water jets. The sprayed water and dislodged dirt particles are collected and carried off via a collection hood or a similar component. The present invention relates to a device, with the aid of which the dirt particles and the waste water can be carried off without difficulty. However, a use for cleaning any belt conveyor is also possible.

In an embodiment, a drainage device (1) for dirt particles and waste water (74) from a cleaning head (50) for cleaning a dryer screen (60) of a paper production plant, the cleaning head (50) being movable transversely to the dryer screen (60), includes an air-water separation container (20) which comprises an inlet opening (25) for the dirt particles and the waste water (74) from the cleaning head (50), an air outlet (27) and a waste water outlet (26), the air-water separation container (20) being connected to the cleaning bead so that the air-water separation container (20) is movable together with the cleaning head (50) transversely to the dryer screen (60).

Since the drainage device comprises an air-water separation container which is connected to the cleaning head and therefore is movable with the cleaning head back and forth transversely to the dryer screen, the air entrained from the cleaning head is separated in the direct vicinity of the cleaning head. Therefore only a short path has to be travelled until the cool waste waiter and the hot air from the cleaning head (which may reach temperatures of about 120° C.) are separated from one another. The air which exits from the cleaning head with the dirt particles and the waste water thus cannot lead to desiccation or coating of the dirt particles. In addition, the length of the path through the drainage device from the dryer screen to the point at which the air is separated from the waste water and the dirt particles is therefore independent of the position of the cleaning head transversely to the dryer screen in such a way that the function of the drainage device ensures an unlimitedly high and uniform quality of the drainage in any desired positioning of the cleaning bead transversely to the dryer screen. The further drainage of dirt particles and waste water after the air-water separation container is approximately air-free and, on the whole, the waste water is only heated minimally by the hot air from the cleaning head.

In an embodiment, the air-water separation container is preferably completely closed, apart from the waste water outlet the air outlet and the inlet opening, preferably in an airtight manner. It preferably consists of a base surface, lateral walls and preferably an upper cover. The air outlet is preferably formed in the upper cover and/or the inlet opening is preferably formed in one of the lateral walls and/or the waste water outlet is preferably formed in the base surface of the air-water separation container. The air-water separation container is preferably cylindrical. The base surface is preferably funnel-shaped towards the waste water outlet, particularly preferably curved in an approximately hemispherical manner. There is thus a gradient towards the waste water outlet.

In an embodiment, the width and depth or diameter of the air-water separation container is preferably in the range of 50 mm to 500 mm, particularly preferably in the range of irons 100 mm to 350 mm, most preferably in the range of from 266 mm to 268 mm. The height of the air-water separation container is preferably in the range of from 50 mm to 300 mm, particularly preferably in the range of from 150 mm to 250 mm, most preferably in the range of from 220 mm to 226 mm.

The inlet opening and/or the air outlet preferably lie in the upper region, whereas the waste water outlet is preferably located in the base region of the air-water separation container.

The air outlet is preferably an opening in the cover of the air-water separation container. A tube piece, as an air outlet connection piece, is preferably attached to the air outlet and protrudes into the interior of the air-water separation container and has the same diameter as the air outlet. Sprayed water is thus prevented from spurting out from inside the air-water separation container via the air outlet.

The waste water outlet is preferably a circular opening in the air-water separation container. The diameter is preferably in the range of from 10 mm to 100 mm, particularly preferably in the range of from 25 mm to 50 mm, and is most preferably approximately 38 mm (1.5").

The air-water separation container and the cleaning head are preferably connected rigidly to one another (for example welded). The cleaning head and the air-water separation container are preferably connected to one another in an airtight manner at the upper opening in the cleaning head, from which the dirt particles and waste water emerge, and the inlet opening in the air-water separation container.

The length of the path through the drainage device from the dryer screen to the waste water outlet is preferably independent of the position of the cleaning head transversely to the dryer screen. The drainage device is preferably dimensioned in such a way that the distance d between the waste water outlet and the cleaning head in the transverse direction is less than the entire width, three quarters of the width or half the width of the dryer screen in any position of the cleaning head transversely to the dryer screen.

In a further embodiment of the present invention the drainage device (1) further comprises a tubular body (10), the cleaning head (50) and the air-water separation container (20) being connected via the tubular body (10). The tubular body preferably has a diameter in the range of from 50 mm to 200 mm, particularly preferably in the range of from 70 mm to 80 mm. The diameter is most preferably approximately 76 mm (3.0") and the wall thickness of the tubular body is approximately 4 mm.

The tubular body is preferably arranged horizontally and is preferably straight. The transverse direction over the dryer screen and the central axis of the tubular body are preferably mutually parallel. It preferably comprises an open and a closed tube end. The tubular body is preferably connected via its open tube end and the inlet opening to the air-water separation container, preferably in such a way that the open tube end projects into the air-water separation container or connects flushly thereto. The open tube end is preferably bevelled and therefore the tubular body has an elliptical opening at this point. The sectional area at the open tube end is particularly preferably adapted to the outer surface of the air-water separation container, i.e. in particular is adapted to the cylindrical outer surface. The tubular body preferably has an opening in its outer surface, to which opening the upper opening in the cleaning head is connected and/or can be connected. The air-water separation container and the cleaning head are preferably interconnected to the tubular body in such a way that this connection is rigid in the transverse direction to the dryer screen. The tubular body and the cleaning head are preferably arranged perpendicularly to one another.

In a further embodiment of the present invention the tubular body (10) comprises at least one propellant inlet (13) for a propellant.

In an embodiment, the propellant inlet is constructed to inject a propellant into the tubular body. It is preferably a nozzle. The propellant is preferably water and/or air, in particular water and/or air under pressure.

In a further embodiment of the present invention at least one of the propellant inlets (13) provided is constructed to accelerate the dirt particles and waste water (74) from the cleaning head (50) and to transport these through the tubular body (10).

The propellant inlet is preferably connected to a closed tube end. It is preferably connected and set up in such a way that the principle of a jet pump is implemented thereby, in accordance with this principle an accelerated propellant entrains air, water and/or further particles. The propellant is set up to be injected into the tube through the propellant inlet and to entrain dirt particles, water and air from the cleaning head through the tubular body towards the open tube end. The opening in the tubular body to which the cleaning head is connected or can be connected via its upper opening is preferably arranged between the propellant inlet and the open tube end which leads into the air-water separation container.

In a further embodiment of the present invention at least one of the propellant inlets (13) provided is arranged substantially coaxially with the central axis of the tubular body (10) and is preferably designed for compressed air.

The propellant inlet is preferably designed to produce a divergent jet which is preferably conical and emits a jet diagonally against the inner wall. The opening angle $\alpha$ is preferably in the range of from 5°-170°, particularly preferably in the range of from 10°-90°. The propellant inlet is preferably connected in the centre of the surface to the closed tube end. The axis of the propellant cone produced through the propellant inlet preferably coincides with the central axis.

The tubular body preferably has propellant inlets distributed annularly around the inner radius of the tabular body, preferably for water under pressure. These propellant inlets are designed to inject additional propellant through the tubular body and towards the open tube end.

In a further embodiment of the present invention at least one propellant inlet (13) is oriented in a direction which is not parallel to the central axis of the tubular body (10).

At least one propellant inlet is preferably oriented in a direction which is oriented diagonally against the inner wall of the tubular body. A propellant can thus be injected into the tubular body in such a way that the propellant is injected against the inner wall of the tubular body, and then propagates spirally through the tubular body towards the open end of the tubular body. With a plurality of propellant inlets distributed preferably annularly around the inner radius of the tubular body, a helical propagation of the propellant in the tubular body can be produced by an orientation which is not parallel to the central axis of the tubular body. The angle β between the central axis of the tubular body and the orientation of a propellant inlet is preferably in the range of from 5°-75°, particularly preferably in the range of from 7°-60°.

A flow is thus formed in the tubular body which approximately completely wets and cools the inner wall of the tubular body. There are thus no points at which dirt particles could dry onto an inner face of the tubular body.

In a further embodiment of the present invention the tubular body (10) and/or the cleaning head (50) have a substantially uniform cross-section.

The tubular body and/or the cleaning head preferably have no constrictions. These are often used in the prior art to achieve a Venturi effect. It has surprisingly been found that constrictions, which are incorporated in conventional systems in order to achieve a Venturi effect, do not achieve the desired positive effect, but instead lead to a more rapid blocking at this constriction.

In a further embodiment of the present invention the cleaning head (50) is pivotably connected to the tubular body (10).

The cleaning head is preferably pivotable about an axis which extends transversely over the dryer screen, which is particularly preferably the central axis of the tubular body. The cleaning head is preferably pivotable about an angle γ in the range of from 5° to 90°, particularly preferably in the range of from 10° to 45°.

In a further embodiment of the present invention the air-water separation container (20) has a removable cover and/or the air-water separation container (20) is cylindrical and/or the cross-section of the air-water separation container (20) tapers in a tunnel-shaped manner towards the waste water outlet (26).

The removable cover is preferably fixable on the air-water separation container via a clasp system in order to enable easy access for cleaning purposes.

In a further embodiment of the present invention the drainage device (1) and/or the cleaning head (50) comprise wall surfaces with thermal insulation.

A thermal insulation is preferably formed by providing the relevant wall surfaces as double wall surfaces. The cavity between the wall surfaces is preferably filled with thermally insulating filler, and is particularly preferably vacuumed.

Owing to an insulation of the wall surfaces, the high external temperature of the paper production plant is not transferred to the inner walls of the discharge device. Heating of the inner walls is thus prevented and desiccation of the dirt particles on the inner surfaces is further effectively prevented. At the same time, the insulation also ensures that the cooling flow inside does not cool the outer walls. The temperature of the outer walls is thus controlled to the external temperature. The saturated ambient air in the paper production plant is thus prevented from condensing on the outer walls of the drainage device. This has the significant advantage that dripping condensation water does not moisten the dryer screen unnecessarily.

In a further embodiment of the present invention the inlet opening (25) produces an inflow into the air-water separation container (20), which inflow has a directional component not perpendicular to a lateral inner face of the air-water separation container (20) in such a way that dirt particles and waste water (74) coming from the tubular body (10) form a vortex-like flow in the air-water separation device (20).

The inflow into the air-water separation container is preferably part of the tubular body which projects through the inlet opening into the air-water separation container.

The direction in which the inflow is oriented can preferably be determined as the central axis of the tubular body in the range of from the open tube end, since this central axis determines approximately the direction in which the waste water with the dirt particles transported through the tubular body would flow into the air-water separation container. Such a direction with a direction component not perpendicular to a lateral inner face of the air-water separation container comprises a direction component tangential to a lateral inner face. The material flow from the tubular body is thus diverted at the lateral inner face without substantially rebounding and spattering. A vortex-like flow in the air-water separation container can thus be produced by the introduction of dirt particles and waste water via the inlet opening, which flow can advantageously be produced in particular by forming the air-water separation container with round wall surfaces (for example forming the air-water separation container as a downwardly hanging hemisphere or as a funnel or as a cylinder).

Owing to the vortex-like flow in the air-water separation container, the dirt particles and waste water move continuously until they flow out through the waste water outlet at the lower end of the air-water separation container. As a result of this continuous movement, dirt particles and waste water are kept in constant suspension. Deposits, which could lead to coatings, are thus avoided. In addition, the vortex-like flow results in an advantageous separation of the entrained air from the suspension without excess formation of a fog caused by injected water. This can then escape upwardly in the air-water separation container through the air outlet.

In a further embodiment of the present invention a waste water hose (30) is connected to the waste water outlet (26), preferably via an angled tube piece (31), and leads to a stationary drainage system, preferably via a device for the movable carrying of cables (32).

The device for movable carrying of cables is preferably a multi-membered system which prevents the waste water hose from becoming kinked when the cleaning head and the air-water separation container move together transversely to the dryer screen. For example, it is a commercially available energy carrying chain.

The waste water hose has a diameter preferably in the range of from 5 mm to 50 mm, particularly preferably in the range of from 12 mm to 25 mm, and the diameter is most preferably approximately 19.5 mm (0.75").

For example, the stationary drainage system is a connection piece which is arranged laterally beside the dryer screen and can be connected to the waste water hose. The connection pipe leads, for example, to a waste water processing system located in the cellar of the production plant.

Owing to the air-water separation in the air-water separation container arranged directly beside the cleaning head, the suspension consisting of waste water and dirt particles can be transported, with no risk of desiccation, through a hose from the components movable transversely to the dryer screen to a location, which is stationary relative to the dryer screen.

In an embodiment, the drainage device preferably also comprises a fill level sensor which is designed to measure fill levels in the drainage device, preferably in the air-water separation container, and to relay this information to a process controller. The drainage device preferably has a process control means which preferably communicates with the process control means for the cleaning head or is identical thereto. The process control means is preferably designed to control the supply of cleaning agents and/or propellants, preferably as a function of at least one fill level detected by a fill level sensor.

In an embodiment, a method for carrying off dirt particles and waste water (74) from a cleaning head (50) for cleaning a dryer screen (60) of a paper production plant, wherein the cleaning head (50) moves transversely to the dryer screen (60), includes the following steps:

entraining an air-water separation container (20) with movement of the cleaning head (50);

collecting the dirt particles and the waste water (74) in the form of a suspension (73) and separating air in an air-water separation container (20);

discharging the air from an air outlet (27) in the air-water separation container (20) and discharging the suspension (73) consisting of the dirt particles and the waste water from a waste water outlet (26) in the air-water separation container (20).

Owing to the entrapment of the air-water separation container the air-water separation process is always carried out in the direct vicinity of the cleaning head. In this way the paths over which there is still a risk of desiccation of dirt particles owing to entrained hot air originating from the cleaning head is kept minimal at any point at which the cleaning head is located transversely to the dryer screen.

The dirt particles and the waste water are collected in that they accumulate in the base region of the air-water separation container and are mixed to form a suspension which is liquid. For this reason dirt particles cannot dry out.

Owing to the separation of air in the air-water separation container, inclusions of air in the suspension are avoided. These could accumulate and could thus pose a risk for coatings in the subsequent drainage system.

The air is preferably discharged from the air-water separation container via a tube piece introduced into the air-water separation container.

In a further embodiment of the method according to the invention the following step is additionally carried out:

acceleration of the dirt particles and the waste water (74) by injection of a propellant into a tubular body (10), which connects the cleaning head (50) and the air-water separation container (20).

Owing to the acceleration of the dirt particles and the waste water in the tubular body, an eddy in the cleaning head connected to the tubular body is preferably produced at the same time. Owing to the acceleration of the dirt particles and the waste water, these are transported through the tubular body towards the air-water separation container.

in an embodiment the propellant is injected at a pressure in the range of from preferably 0.5 to 6.5 bar, and the pressure is particularly preferably 6.0 bar.

The propellant is preferably injected in the direct vicinity of an opening in the tubular body to which the cleaning head is connected.

In a further embodiment of the method according to the invention the following step is additionally carried out:

production of a spiral or helical flow by injection of a propellant into a tubular body (10) which connects the cleaning head (50) and the air-water separation container (20).

A spiral or helical flow is preferably produced by the inclined injection of one or more propellants against the inner wall of the tubular body. An approximately complete wetting of the inner face of the tubular body is ensured as a result of such a flow and desiccation is thus prevented.

In a further embodiment of the method according to the invention the following step is additionally carried out:

production of a vortex-like flow in the air-water separation container (20).

The flow from the tubular body consisting of waste water, dirt particles and propellants is preferably carried diagonally against the inner face of the air-water separation container so that it circulates in the air-water separation container and flows off towards the waste water outlet. Owing to the production of a vortex-like flow, the dirt particles, waste water and propellant are mixed together thoroughly. In addition, injected water or dead regions where the flow does not reach are prevented by the vortex-like flow.

In a further method according to the invention the method is carried out during a cleaning process of the dryer screen (60), wherein the cleaning process is preferably carried out at the same time as a paper production process.

This means that the paper production process is not interrupted in order to clean the dryer screen and dry it alter the cleaning process. Screen cleaning, screen drying, the method according to the invention for carrying off dirt particles and waste water and the paper production process are carried out at the same time. A continuous operation is preferably carried out in parallel with a paper production process. Whilst the dryer screen dries paper at one point, it is cleaned at another point of the paper production plant by a cleaning head and the method according to the invention is carried out during this cleaning process. It is thus possible, for the first time, to carry out continuous cleaning during the operation of a paper production plant. Coatings and blockages are effectively prevented by the well thought-out removal of dirt particles, and only a fraction of the previously required rinsing water is thus necessary. When using a water-saving cleaning head only a fraction of the water normally necessary for basic cleaning of a dryer screen is thus used. It is thus possible to minimise water consumption, in spite of continuous cleaning, and continuous cleaning is thus an attractive option for the first time. Downtime of the paper production plant is avoided, thus increasing efficiency of production. In addition, not much dirt can accumulate in the dryer screen owing to the continuous cleaning, thus reducing the cost of cleaning.

In a further embodiment of the method according to the invention a fill level of the dirt panicles and waste water (74) and/or propellant and/or suspension (74) is measured by at least one fill level sensor (80).

A fill level in the air-water separation container is preferably measured. A fill level is relayed to a process controller, particularly preferably if a maximum fill level has been reached. The process controller preferably varies the supply of cleaning agents and/or propellants as a function of at least one fill level, particularly preferably as a function of the reaching of a maximum fill level.

FIG. 1 is a view of a drainage device 1 according to the invention which is connected to a cleaning head 50. The view is a section through a drainage device 1. The running direction of the dryer screen 60 stands perpendicular to the plane of projection. This orientation is used in FIGS. 1 to 5. The cleaning head 50 is connected via the dryer screen 60 and comprises at Its upper end a lateral opening. An air-water separation container 20 is connected directly to the cleaning head 50. It comprises an air outlet 27 in its upper face and a waste water outlet 26 in its lower face—it preferably being possible for said waste water outlet 26 to be equipped with a hose for removing the waste water. To the side it has an inlet opening 25. The cleaning head 50 and the air-water separation container 20 are interconnected in such a way that the interiors thereof communicate via the inlet opening 25 in the cleaning head and the inlet opening 25 in the air-water separation container 20.

During operation of the cleaning head 50, it moves in the transverse direction to the dryer screen 60 towards the left and/or towards the right (indicated by a double-headed arrow). The air-water separation container 20 is also entrained. Dirt particles 74, which are detached from the dryer screen 60 during the cleaning process and, for example, are transported upwardly by rinsing jets arranged in the cleaning head 50, arrive in the air-water separation container 20 with waste water through the inlet opening 25. In the base region thereof the waste water accumulates with the dirt particles in the form of a suspension which flows further through the waste water outlet 26 and is carried off. Air escapes through the air outlet 27.

Since an air-water separation container 20 is connected directly to the cleaning head 50 and follows the transverse movements of the cleaning head 50, the path which the dirt particles and the waste water 74 have to cover through the drainage system until they form a liquid suspension is much shorter compared so the prior art irrespective of the position of the cleaning head 50. As soon as a liquid suspension is formed, this can be carried off without difficulty in hoses having a small diameter. Since no more air can be entrained, there is no longer a risk of coatings or desiccations. The air from the cleaning head 50 can escape through the air outlet 27. Dirt particles and waste water 74 are not shown in detail in the figures below.

Figure 2:
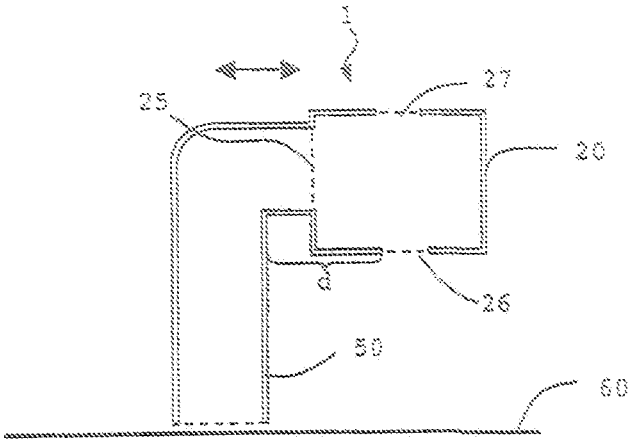
FIG. 2 shows a drainage device according to an embodiment of the invention which is connected to a cleaning head which comprises a curvature at its upper end.

FIG. 2 shows a drainage device 1 according to the invention which is connected to a cleaning head 50 which comprises a curvature at its upper end. The difference from FIG. 1 is that the cleaning head 50 comprises a curvature at its upper end. This means that different cleaning heads can be used. The distance d between the waste water outlet and the cleaning head in the transverse direction is also shown.

Figure 3:
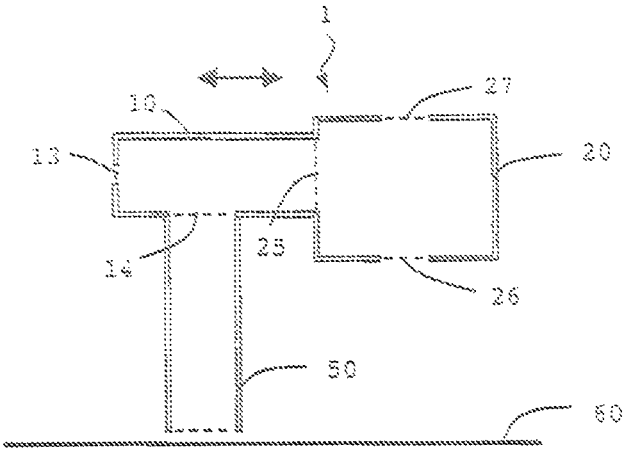
FIG. 3 shows a drainage device according to an embodiment of the invention, wherein the cleaning head and the air-water separation container are interconnected via a tubular body.

FIG. 3 is a view of a drainage device 1 according to the invention, wherein the cleaning head 50 and the air-water separation container 20 are interconnected via a tubular body 10. The tubular body 10 comprises a propellant inlet 13 and a connection opening 14 for a cleaning head 50.

During operation of the drainage device 1, compressed air is injected through the tubular body 10 via the propellant inlet 13. The compressed air entrains further air from the cleaning head 50, thus producing a vacuum at the connection point between the tubular body 10 and the cleaning head 50. Waste water and dirt particles are transported from the cleaning head into the tubular body 10 as a result of this vacuum and are driven further into the air-water separation container 20 by the compressed air. As a result of this construction, an eddy is produced in the cleaning head by simple means and a very good transport of waste water and dirt particles into the air-water separation container 20 is achieved simultaneously.

Figure 4:
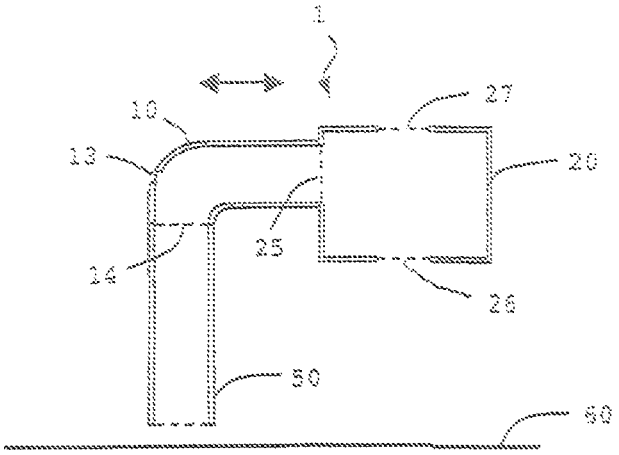
FIG. 4 shows a device according to an embodiment of the invention, wherein the tubular body comprises a curvature.

FIG. 4 is a view of a device 1 according to the invention, wherein the tubular body 10 comprises a curvature. The difference from FIG. 3 is that the tubular member 10 comprises a curvature and therefore the connection opening 14 for the cleaning head 50 matches an open tube end of the tubular body 10. As before, the tubular body 10 is also connected to the air-water separation, container 20 at the inlet opening 25 via the other open tube end.

Figure 5:
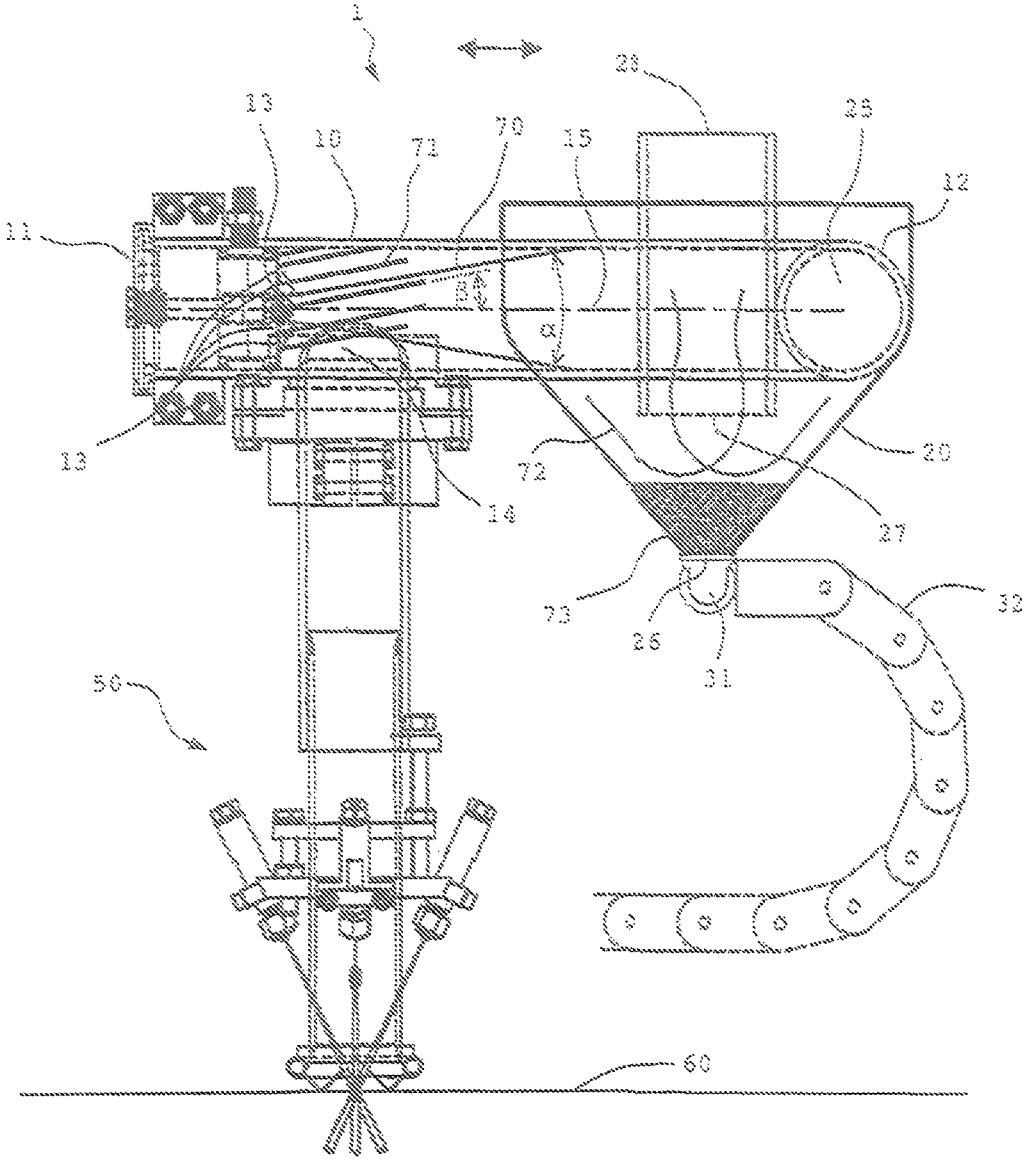
FIG. 5 is a front view of a drainage device according to an embodiment of the invention.

FIG. 5 is a drawing of a front view of a drainage device 1 according to the invention, wherein the tubular body 10 comprises further propellant inlets 13 which are designed to produce a helical flow in the tubular body 10, and wherein the air-water separation container 20 is funnel-shaped and comprises an air outlet connection piece 28, and wherein a waste water hose 30 is connected to the waste water outlet 26 via an angled tube piece 31 and is led away via a device for the movable carrying of cables 32. In addition to a propellant inlet 13 designed as a nozzle, the tubular body 10 also comprises propellant inlets 13 for water under pressure. The nozzle 13 for compressed air is oriented coaxially with the central axis 15 of the tubular body 10 and is designed to produce a divergent compressed air jet 70 with an opening angle $\alpha=18°$. The propellant inlets 13 for water under pressure are distributed annularly around the nozzle 13 and are designed to produce water jets 71. The propellant inlets 13 for water under pressure are each oriented diagonally against the inner wall of the tubular body 10 at an angle $\beta=10°$. The orientation includes a substantial portion of a direction component which points from the closed end face 11 towards the open tube end 12 of the tubular body 10. The air-water separation container 20 comprises a funnel-shaped constriction in the lower region. An air outlet connection piece 28 is introduced into the air-water separation container 20 from above. An angled pipe piece 31 is screwed onto the waste water outlet 26 and a waste water hose 30 is connected, in turn, to said angled tube piece. This hose is coupled to a further stationary drainage system via an energy carrying chain 32.

During operation of the drainage device 1, the propellant inlets 13 for water under pressure produce an additional rinsing which progresses helically through the tubular body 10 and rinses over the inner walls of the tubular body. At the same time the injected water under pressure binds dirt particles and waste water coming from the cleaning head 50. Owing to the open tube end 12 and the inlet opening 25, this flow flows into the air-water separation container 20. At the same time a divergent compressed air jet 70 is produced through the nozzle 13 and in turn produces an eddy in the cleaning head 50 in accordance with the jet pump principle and additionally cooperates with the rinsing flow. The material flow entering the air-water separation container 20 contacts the inner wall of the air-water separation container at a slightly inclined angle and thus forms a vortex which moves towards the waste water outlet 26. The rinsing and waste water as well as the dirt particles form a suspension 73, at the latest in the funnel-shaped region of the air-water separation container 20. Separated air 72 escapes through the air outlet 27 and the air outlet connection piece 28. The suspension 73 then flows via the angled tube piece 31 into the waste water hose 30. The components moving transversely to the dryer screen 60 (cleaning head 50, tubular body 10, air-water separation container 20, angled tube piece 31) transition into the stationary drainage system by a multi-membered energy carrying chain 32 which carries the waste water hose 30.

Owing to the additional propellant inlets 13 for water under pressure, the tubular body 10 is effectively rinsed through, in particular by the production of a helical flow front the water jets 71. Owing to the inclined discharge of the tubular body 10 into the air-water separation container 20, as shown, a vortex is produced in a controlled manner. This is also promoted by the funnel-shaped design of the air-water separation container 20. Owing to the vortex, the material flow flowing into the air-water separation container 20 is always moving. Regions in which dirt residues could accumulate are thus effectively avoided. Dirt particles and waste water may advantageously accumulate on the base of the air-water separation container 20 as a suspension 73 and air can escape in a very effective manner. Injected water is prevented from escaping outwardly by the air outlet connection piece 28.

Figure 6:
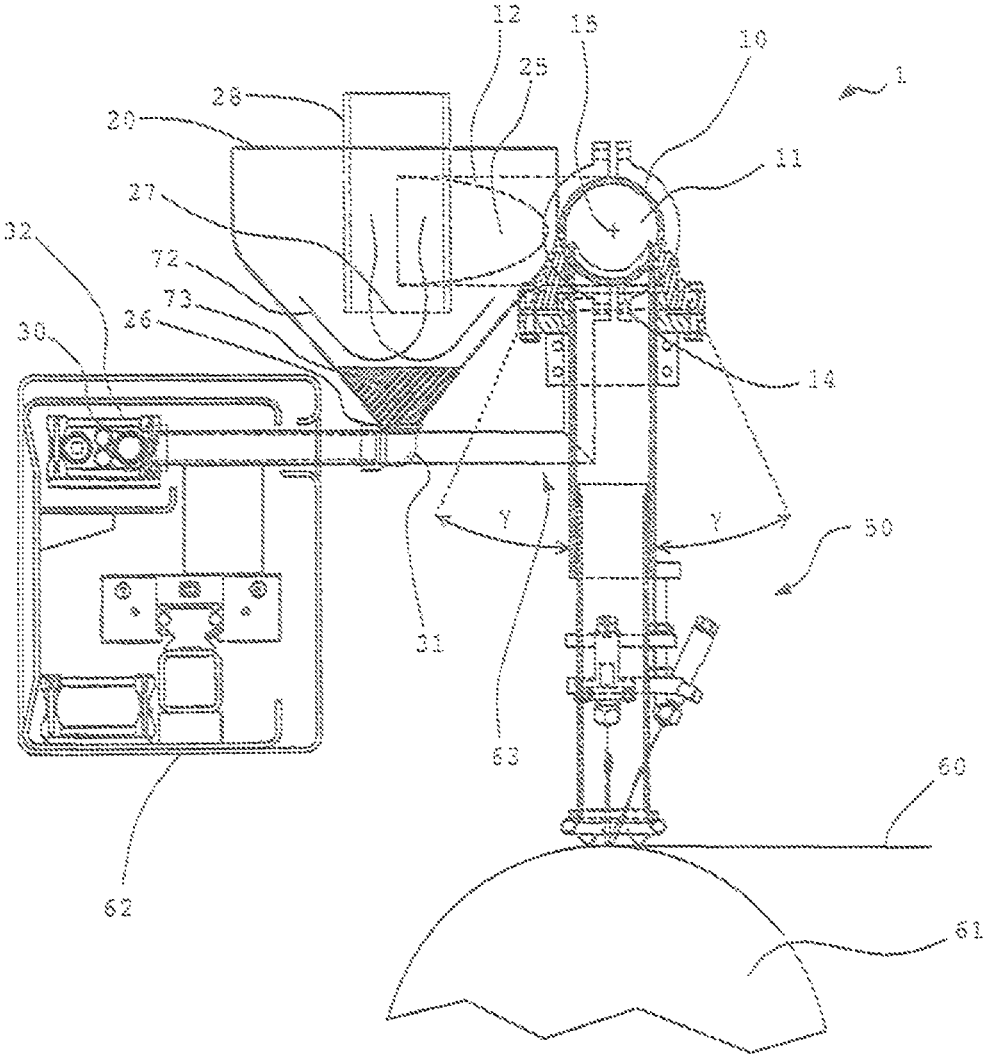
FIG. 6 is a side view of the drainage device from FIG. 5.

FIG. 6 is a drawing of a side view of the drainage device from FIG. 5. The cleaning head 50 is located in the range of from a roller 61 of the paper production plant, via which the dryer screen 60 is returned. The cleaning head 50 is pivotably connected to the tubular body 10. It can be pivoted back and forth through $\gamma=25°$ about an axis parallel to the axis of the roller 61. The connection point between the tubular body 10, air-water separation container 20 and cleaning head 50 is mounted via a holder 63 in a support beam 62 arranged transversely above the paper production plant so that it can be moved to and fro transversely to the dryer screen 60.

Owing to the pivot connection between the cleaning head 50 and the tubular body 10, the cleaning head 50 can be positioned in a versatile manner and also stored in a space-saving manner if it is not required.

Figure 7:
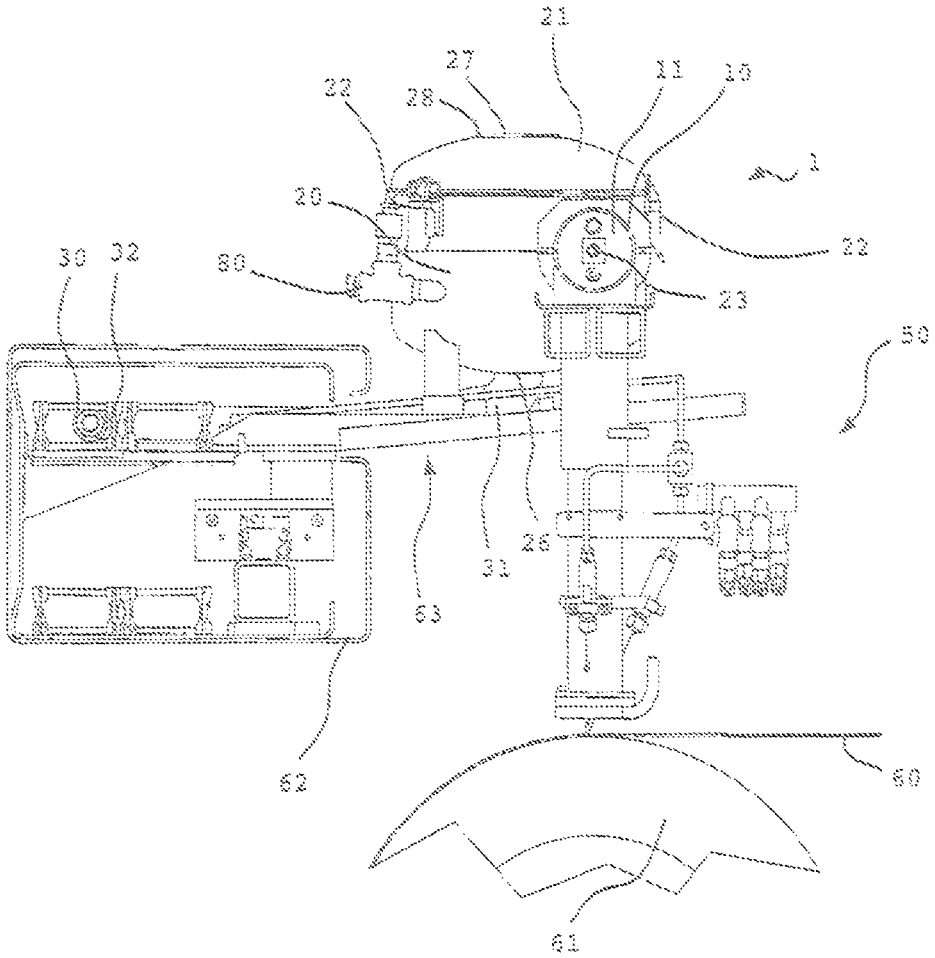
FIG. 7 is a perspective illustration of a side view of a drainage device according to an embodiment of the invention, wherein the air-water separation container is substantially cylindrical and comprises a removable cover.

FIG. 7 is a perspective illustration of a side view of a drainage device 1 according to the invention, wherein the air-water separation container 20 is substantially cylindrical and comprises a removable cover 21. The removable cover 21 is fixable on the air-water separation container 20 via clasps 22. The cylindrical air-water separation container 20 is slightly curved outwardly on its lower face. The tubular body 10 also comprises a compressed air connection point 23. A fill level sensor 80 is connected to the air-water separation container 20.

During operation the fill level sensor 80 controls the fill level in the air-water separation container 20 and relays this to the process controller. If the fill level exceeds a specific threshold value, the process controller switches off or reduces the supply of rinsing and/or cleaning water.

As a result of the removable cover 21, the drainage device 1 can be serviced in a simple manner. The predominantly cylindrical design of the air-water separation container 20 with a convex base surface can be produced more cost effectively and saves space in the vertical direction. Owing to the lower outwards curvature of the air-water separation container 20, dirt particles and waste water can still be carried effectively towards the waste water outlet 26.

FIG. 8 is a diagonal front view of a perspective illustration of a drainage device 1 according to the invention, wherein the transition between the tubular body 10 and the air-water separation container 20 can be seen. This illustration shows an inflow of the tubular body 10 into the air-water separation container 20, which inflow comprises a direction component not perpendicular to the lateral face of the air-water separation container 20. The inflow direction is approximately tangential to the lateral inner face of the air-water separation container at the point of the inlet opening 25. The tubular body 10 also comprises a pressure water connection point 24 for the propellant inlets 13 for water under pressure located in the tubular body 10.

Owing to the approximately tangential inflow of the tubular body 10 into the air-water separation container 20, a vortex is particularly effectively produced in the air-water separation container 20.

Figure 9:
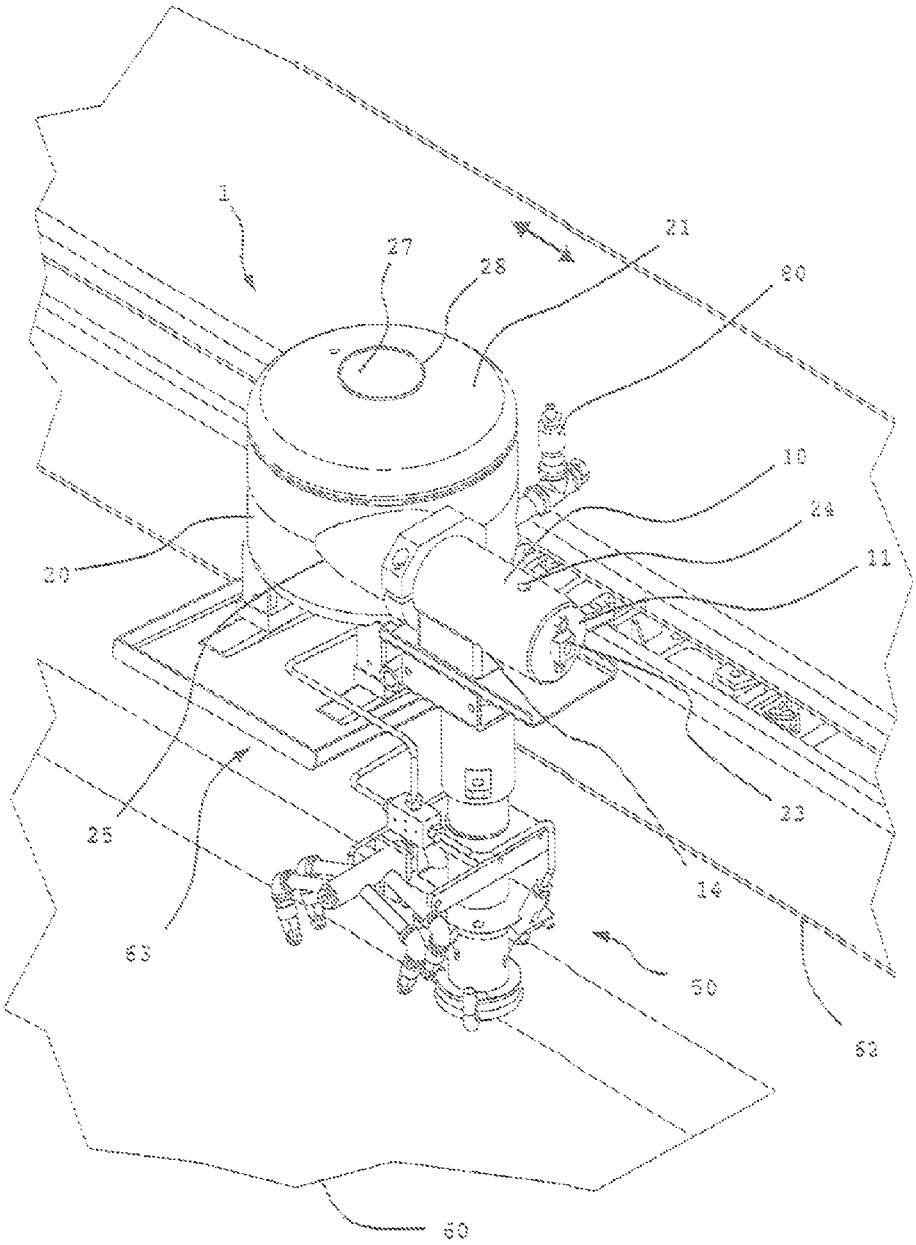
FIG. 9 is a view of a section through a perspective illustration of a drainage device according to an embodiment of the invention, wherein the air-water separation container is double-walled and comprises a vacuumed cavity tor thermal insulation.
Figure 9:
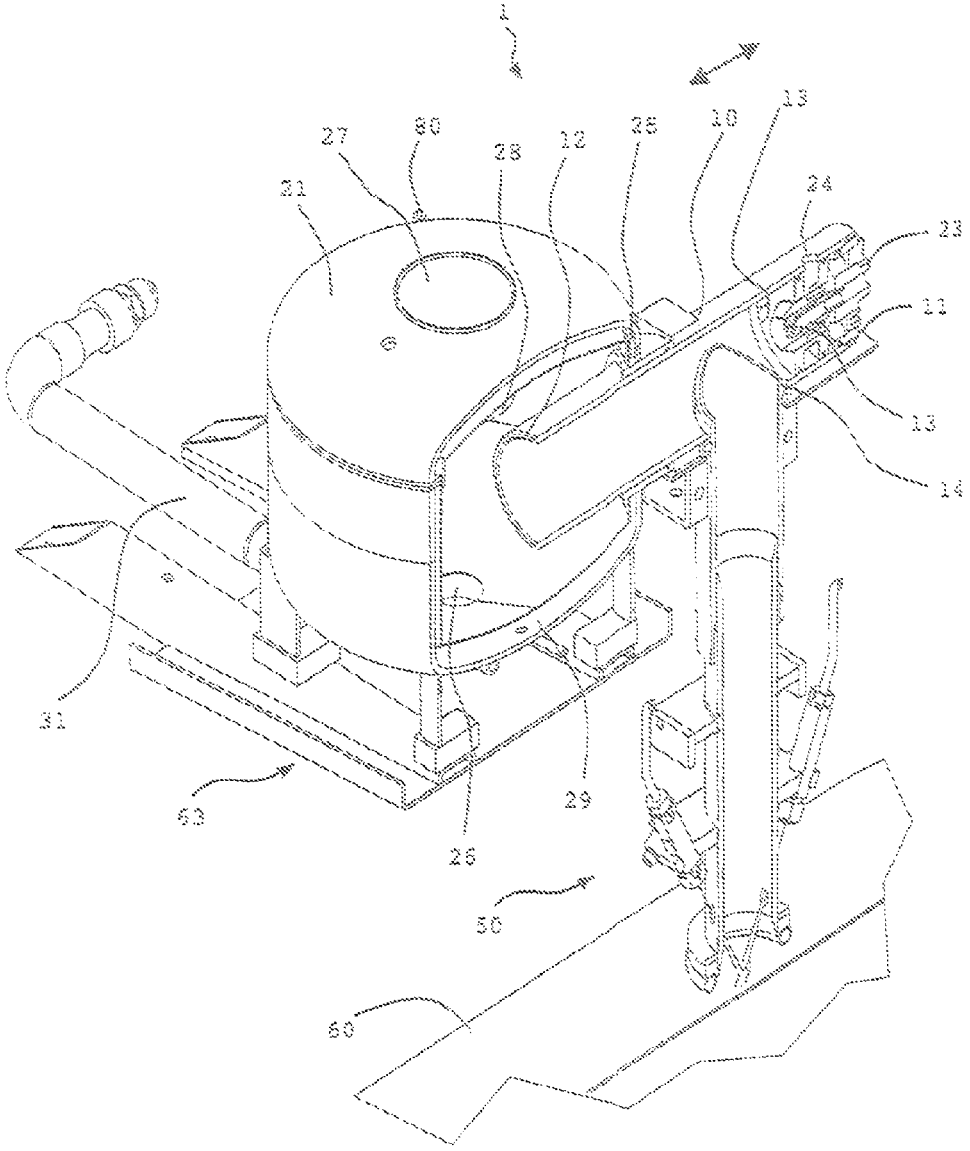

FIG. 9 is a view of a section through a perspective illustration of a drainage device 1 according to the invention, wherein the air-water separation container 20 is double-walled and comprises a vacuumed cavity 29 tor thermal insulation.

Owing to the double wall and furthermore the vacuum within the cavity 25, the interior of the air-water separation container 20 is effectively thermally insulated against the high ambient temperature and therefore coatings and desiccations are effectively prevented.

The preferred embodiment of the invention comprises a tubular body 10 which connects the air-water separation container 20 and the cleaning head 50. In addition, the tubular body 10 comprises both a propellant inlet 13 for compressed air arranged coaxially with the central axis 15 and propellant inlets 13 for water under pressure distributed uniformly annularly around said propellant inlet 13 for compressed air. The propellant inlet 13 for compressed air is designed for the production of a divergent compressed air jet 70 with $\alpha=18°$, and the propellant inlets 13 for water under pressure are designed for the production of water jets 71 with $\beta=10°$, these producing a helical flow through the tubular body 10. The tubular body 10 also comprises a closed end face 11 and a lateral connection opening 14 for the cleaning head 50. The cleaning head 50 is connected to the tubular body 10 so as to be pivotable through $\gamma=25°$. The air-water separation container 20 is cylindrical and funnel-shaped in the lower region. In addition, it comprises a removable cover 21 which can be fixed via clasps 22 and an air outlet connection piece 28 which is carried from above into the air-water separation container 20. The air-water separation container 20 and the tubular body 10 are further double-walled and the cavities 25 thereof are each vacuumed so that they are thermally insulated against the outside environment. The waste water hose 30 is carried via a carrying chain 32 to a stationary drainage system. The inflow of the tubular body 10 is approximately tangential to the inner face of the air-water separation container 20 so that a strong vortex is produced inside the air-water separation container. A plurality of fill level sensors 80 fitted on the device 1 measure fill levels in the device 1 and send these to a process controller. The amounts of cleaning fluid and propellants vary depending on the fill levels.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1 drainage device
10 tubular body
11 closed end face
12 open tube end
13 propellant inlet
14 connection opening tor a cleaning head (50)
15 central axis
20 air-water separation container
21 removable cover
22 clasp
23 compressed air connection point
24 pressure water connection point
25 inlet opening
26 waste water outlet
27 air outlet
28 air outlet connection piece
29 cavity
30 waste water hose
31 angled tube piece

32 device for movable carrying of cables
50 cleaning head for cleaning a dryer screen (60) of a paper production plant
60 dryer screen of a paper production plant
61 roller
62 support beam
63 holder
70 compressed air jet
71 water jet
72 separated air
73 suspension of dirt particles and waste water
74 dirt particles and waste water
80 fill level sensor

What is claimed is:

1. A method for carrying off dirt particles and wastewater from a cleaning head of a dryer in a paper production plant, the cleaning head entraining hot air and collecting dirt particles and wastewater during cleaning of a dryer screen using high-pressure fluid jets, the cleaning head including an opening via which the dirt particles and wastewater exit the cleaning head, said method comprising:

rigidly mounting an air-water separation container to the cleaning head in direct vicinity of the opening in the cleaning head, the air-water separation container including an air outlet, a wastewater outlet and an inlet opening for receiving the dirt particles and wastewater from the opening in the cleaning head;

moving the cleaning head transversely with respect to the dryer screen so as to entrain the air-water separation container connected to the cleaning head;

transporting the hot air, dirt particles and wastewater from the dryer screen to the air-water separation container via the cleaning head over a substantially constriction-free path of substantially constant length as the air-water separation container moves transversely to the dryer screen with the cleaning head, the length of the path being independent of a position of the cleaning head transversely to the dryer screen;

collecting the dirt particles and the wastewater in a liquid suspension in the air-water separation container;

separating the hot air from the suspension of dirt particles and wastewater in the air-water separation container, said separating occurring in direct vicinity of the cleaning head prior to substantial desiccation or coating of the dirt particles within the dryer;

discharging the air from the air outlet in the air-water separation container; and discharging via a hose the suspension from the wastewater outlet in the air-water separation container.

2. The method as recited in claim 1, further comprising injecting a propellant into a tubular body connecting the cleaning head and the air-water separation container so as to accelerate the dirt particles and the wastewater.

3. The method as recited in claim 1, further comprising producing a vortex-like flow in the air-water separation container.

4. The method as recited in claim 1, further comprising injecting a propellant into a tubular body connecting the cleaning head and the air-water separation container so as to produce one of a spiral and a helical flow.

5. The method as recited in claim 2, further comprising measuring a fill level of at least one of the dirt particles and the wastewater, the propellant and the suspension using at least one fill level sensor.

6. The method as recited in claim 3, wherein the cleaning process is performed at the same time as a paper production process.

7. The method as recited in claim 1, wherein this method is performed during a cleaning process of the dryer screen.

8. A method for making paper in a paper production plant comprising the method of carrying off dirt particles and wastewater from a cleaning head for cleaning a dryer screen as defined in claim 1.

* * * * *